United States Patent [19]

Wigand

[11] 4,226,372

[45] Oct. 7, 1980

[54] DEVICE FOR THE DESTRUCTION OF MICROFILM AND SIMILAR DATA CARRIERS

[76] Inventor: Gerhard Wigand, Enzstrasse 17, 7140 Ludwigsburg, Fed. Rep. of Germany

[21] Appl. No.: 949,404

[22] Filed: Oct. 10, 1978

Related U.S. Application Data

[63] Continuation of Ser. No. 792,098, Apr. 29, 1977, abandoned.

[30] Foreign Application Priority Data

Sep. 15, 1976 [DE] Fed. Rep. of Germany ..... 2641370

[51] Int. Cl.[3] ..... B02C 18/22

[52] U.S. Cl. ..... 241/34; 83/356.3; 83/422; 241/160; 241/223; 241/243

[58] Field of Search ..... 241/160, 223, 243, 222, 241/34, 32; 83/356.3, 356.1, 62, 422, 906, 355, 349

[56] References Cited

U.S. PATENT DOCUMENTS

| | | | |
|---|---|---|---|
| 864,552 | 8/1907 | Perkins et al. | 83/356.3 |
| 1,874,902 | 8/1932 | Clyne | 83/906 X |
| 2,841,341 | 7/1958 | Noble et al. | 241/243 |
| 3,228,274 | 1/1966 | Cagen | 83/355 X |
| 3,353,754 | 11/1967 | Heijnis et al. | 241/243 X |
| 3,545,686 | 12/1970 | Brown | 241/243 X |
| 3,750,512 | 8/1973 | Gotham et al. | 83/356.3 |
| 3,762,256 | 10/1973 | Frantz | 83/356.3 |
| 3,812,749 | 5/1974 | Lowen et al. | 83/356.3 X |
| 3,974,725 | 8/1976 | Boots | 83/356.3 X |

*Primary Examiner*—Frank T. Yost
*Attorney, Agent, or Firm*—Joseph A. Geiger

[57] ABSTRACT

A device for the destruction of microfilm and similar data carriers with microimage impressions which is designed to shred the data carriers by means of a rotating shredding cutter in the form of a plain milling cutter whose teeth move past a transversely extending stationary cutting edge. A strip feeding unit advances the data carrier strip past this cutting edge along a guide plate, said unit including a driven endless conveying member which forms a conveying gap with the guide plate. A second stationary cutting edge forms a second cutting point behind the first cutting point. The strip feeding unit is self-contained and movable against a spring bias in relation to the main frame and its guide plate, so that a safety switch, responding to such movement, stops the device when too many data carriers are fed into the device simultaneously.

21 Claims, 18 Drawing Figures

VI
68
56
57
102
96
38
104
72
74
40
70
26
78
VI
112

70
72

78
74
92
40
100
V
V
38
96
98
62
54
32
62

DEVICE FOR THE DESTRUCTION OF MICROFILM AND SIMILAR DATA CARRIERS

This is a continuation of application Ser. No. 792,098 filed Apr. 29, 1977 now abandoned.

BACKGROUND OF THE INVENTION

1. Field of the Invention

The present invention relates to cutting and shredding devices, and, more particularly, to shredding devices designed for the destruction of microfilm and similar information carriers carrying microimage impressions.

2. Description of the Prior Art

In recent years, microfilm has come into increasing use as a microimage data carrier for the long-term storage of a great variety of information. Most commonly, these microfilm data carriers take the shape of film reels, film sheets, so-called microfiches, or microfilm sections which form a part of punched cards. The information which is stored on microfilm is of a permanent nature and cannot be erased, should it become obsolete. In the case of microfilm information of a confidential or proprietary nature which has become obsolete, or otherwise requires destruction, the destruction of the microimage data can only be accomplished by destroying the data carrier itself.

While one might assume that microfilm can be shredded in much the same way as paper is being shredded, it has been found that paper shredders are generally unsuitable for the destruction of microfilm, even if they are capable of cutting the much tougher film stock. More importantly, however, the size of the shreds produced by paper cutters is much too large for a safe destruction of the microimage information involved, considering the greatly reduced scale on which this information is registered on the microfilm carrier.

Known document shredders, as a rule, cut each sheet of paper into a large number of narrow longitudinal strips, as the sheet is fed between rotary cutters. For technical reasons, it is not possible to modify these cutters so that they form an arrangement of sufficiently compact and closely spaced dimensions that would enable them to effectively destroy microfilm.

A further shortcoming of these prior art devices lies in the uninterrupted working contact between the shredding cutters and the material to be shredded. This means that, because of the inevitable generation of friction, the shredding cutters build up heat which is transferred to the material to be shredded, with the result that the latter softens and develops a tendency to pack together, including the possibility of becoming bonded to the cutters.

Large-capacity shredder installations which are designed for the destruction of office materials of all kinds, including the shredding of entire file folders, are generally too bulky and also too costly for most applications. Also, these high-powered installations produce a shredded waste whose particles are still too large to be acceptable for the purpose of destroying microfilm data carriers.

The thermal destruction of microfilm data carriers is not practical, due to the move away from flammable film stock to nonflammable safety film stock. Increasingly, the material used for microfilm is a highly resistant film strip of polyester which is so resistant to tearing and cutting that the above-mentioned known shredding devices are simply incapable of cutting it. In many instances, therefore, where information could be advantageously stored on microfilm, such storage is foregone, because of the inability of effectively destroying the microfilm data, when they are obsolete.

SUMMARY OF THE INVENTION

It is, therefore, a primary objective of the present invention to offer a better solution to the problem of destroying microfilm data carriers, the solution being aimed at overcoming most or all of the above-mentioned shortcomings with a device which can be manufactured at a reasonable cost and which is capable of reliable operation on a continuous basis, if necessary.

In order to attain these objectives, the present invention suggests a novel device for the destruction of microfilm and similar data carriers which is designed to cut an advancing strip of microfilm in the transverse sense with at least two cutting edges which touch the film material only briefly, in an intermittant shear-type cutting action which is produced by an encounter of the cutting edges. This intermittant cutting action allows for the generated heat to dissipate sufficiently rapidly, so that, even under continuous operation, the temperature buildup on the cutting edges will safely remain below the critical level at which the microfilm strip which is being shredded would become soft. The cutting edges are preferably a succession of cutter teeth.

The novel device preferably also includes a strip feeding unit which imposes a controlled rate of advance to the material which is to be cut, this rate of advance being coordinated with the cutting frequency of the cutter teeth, so as to exactly control and maintain a desired succession of cuts at which the size of the resulting material shreds are so small that the microimage information on the shredded material is no longer readable and is thus safely destroyed.

The invention further suggests that the cooperating cutting edges preferably be so arranged that one of the cutting edges is stationary, while the other cutting edge is a cutter tooth moving past the stationary cutting edge at a minimal distance. The stationary cutting edge may simply be the edge of a guide plate. The cooperating moving cutting edge is part of a toothed shredding cutter, preferably in the shape of a plain milling cutter of cylindrical outline, whose rotational axis is parallel to the edge of the stationary cutter plate. Such a shredding cutter may be of the straight fluted type or of the helically fluted type. The use of a milling cutter of conventional tooth shape has the advantage that standard cutter grinding equipment can be used to sharpen the teeth, in case the shredding cutter is worn dull.

By way of a further improvement, the present invention also suggests that the cooperating cutting edges not be straight lines, but that they preferably have an undulating or zigzag configuration, so as to produce a serrated cut outline which increases the micronization of the microfilm material. The most simple zigzag line is a common thread profile, milling cutters with such a profile being commercially available, or relatively easy to manufacture.

A further improvement suggested by the present invention involves the arrangement of a second stationary cutting edge at a distance from the first cutting edge, along the path of the moving cutting edge, so that the previously produced film material shreds are subjected to a second shredding action, with the result that the microfilm material is effectively micronized and its information completely destroyed. Such an arrangement of two spaced stationary cutting edges, by doubling the cutting action of each cutter tooth, correspondingly increases the cutting capacity of the device, which means that the feed velocity of the microfilm can be increased, without necessitating a corresponding increase in the cutting frequency, as reflected by the peripheral speed of the shredding cutter and the circumferential pitch of the cutter teeth. Between the spaced stationary cutting edges is preferably arranged a special chamber into which the shreds from the first cutting action are ejected, the chamber having a shape which facilitates the intermingling of the ejected microfilm shreds, before they are cut again in a second shredding action, at the other stationary cutting edge.

Another suggestion offered by the present invention relates to means for forcibly feeding the film strip to the cutting edges at a controlled predetermined speed, which is preferably adjustable. This strip feeding means preferably includes a conveyor-type strip feeding unit which cooperates with the guide plate whose edge constitutes the first stationary cutting edge which cooperates with the shredding cutter.

Still another advantageous suggestion is realized in the preferred embodiment, in that the steel of which the shredding cutter is made is preferably harder and more resistant than the material of the cooperating guide plate which forms the stationary cutting edge, and that these two materials are so coordinated that they permit sliding friction between them during the cutting action. The shredding cutter, therefore, is preferably of hardened tool steel, while the cooperating stationary plate is of copper, bronze, brass, or a similar comparatively soft low-friction metal. With such a cutting combination, it is merely necessary to provide for a plate adjustment mechanism by means of which the plate can be slowly advanced against the rotating shredding cutter, in order to thereby produce a precisely matching counter-profile on the stationary cutting edge. At the same time, the service life of the cutting edges of the shredding cutter teeth is extended to a maximum, as the stationary cutting edge cannot damage the rotating cutting edges.. The aforementioned strip feeding unit and its drive, as well as the cooperating adjustable guide plate with its stationary cutting edge, are preferably arranged between vertical frame members of the device. The latter also accommodate suitable journals for the shredding cutter shaft.

The conveyor-type strip feeding unit preferably consists of at least two parallel guide rolls and of a plurality of endless round or flat belts arranged side by side over the width of the cooperating guide plate. One belt run is arranged parallel to and at a small distance from said plate. The endless belts may also be of the timing belt type, in which case the belt, or belts, are preferably inverted, so as to engage the film strip with the belt teeth. On the opposite side of the conveyor, the outwardly facing belt teeth can then be used to cooperate directly with the drive pulley of a gear motor. In the case of a smooth endless belt, or belts, the distal guide roller may be directly coupled to the gear motor, or it may be connected to it by means of a suitable chain drive or timing belt drive.

The invention further suggests that the novel strip feeding unit of the device be mounted inside a frame or housing, so as to form a self-contained unit which is so arranged in relation to the device that it can be removed, at least a short distance, for inspection and servicing access to the shredding cutter and to the cooperating guide plate. This removable self-contained strip feeding unit is preferably guided for either a pivoting motion or a straight-line motion.

The guided mobility of the removable strip feeding unit can also be taken advantage of by maintaining the unit in its operating position under a spring bias, against which it can move, in the event that several superposed film strips, or an object thicker than a single film strip is accidentally being fed into the device. This movement can be conveniently used to operate a safety switch.

By way of a further refinement of the invention, the aforesaid movement of the strip feeding unit can be used to actuate a three-stage switch which is so adjusted that the simultaneous insertion of only two layers of microfilm will not shut down the device, but will simply automatically reduce the speed of the strip feeding unit, while the simultaneous insertion of more than two thicknesses of microfilm will shut down the device.

BRIEF DESCRIPTION OF THE DRAWINGS

Further special features and advantages of the invention will become apparent from the description following below, when taken together with the accompanying drawings which illustrate; by way of example, several embodiments of the invention, represented in the various figures as follows.

DESCRIPTION OF THE PREFERRED EMBODIMENTS

Figure 1:
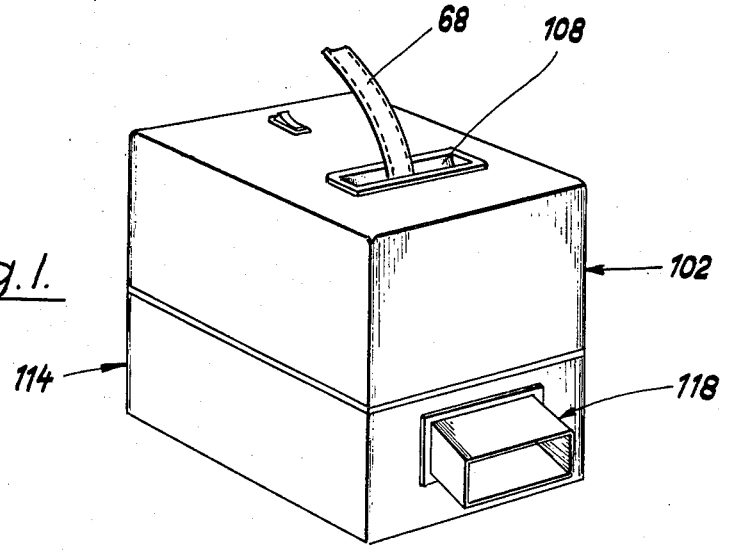
FIG. 1 shows a first embodiment of the invention in a perspective outside view.

Referring to the drawings, FIGS. 1 through 7 thereof illustrate a first embodiment of a shredding device for microfilm and similar data carriers, as suggested by the present invention. This device consists essentially of a shredding unit 20 (FIG. 7), a strip intake unit 22 (FIG. 2), and a strip feeding unit 24 (FIG. 6), portions of cooperating units being, in some cases, spatially and operationally combined.

Figure 6:
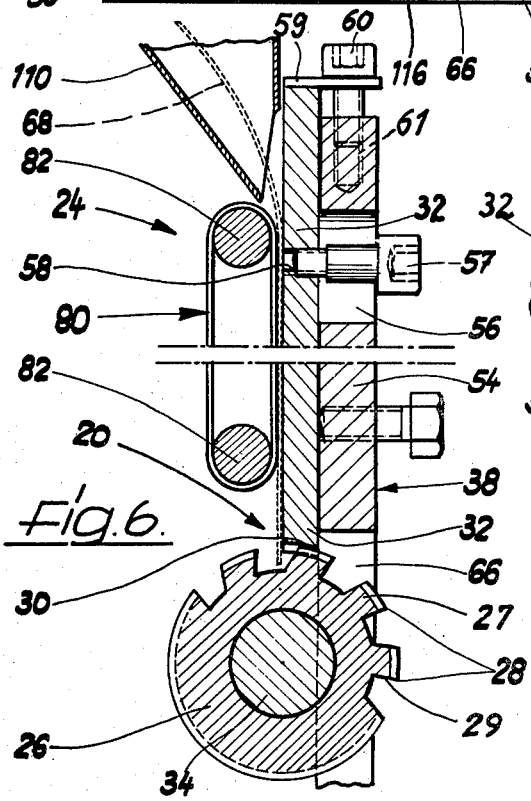
FIG. 6 is a partial longitudinal cross section through the device of FIG. 1, as taken along line VI—VI of FIG. 3.
Figure 7:
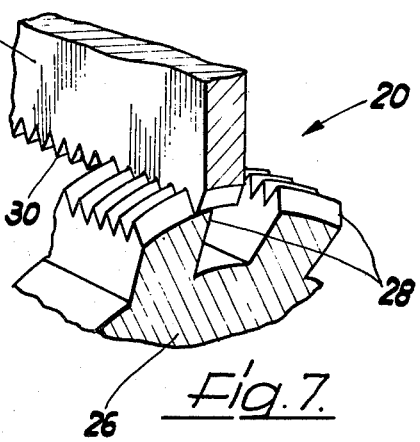
FIG. 7 shows selected details of the device of FIG. 1 in an enlarged perspective representation.

The shredding unit 20 of the device is essentially constituted by a shredding cutter 26 which has the form of a conventional plain milling cutter. The rotating cutter 26 cooperates with a stationary cutting member 32 in a shearing configuration (see FIGS. 6 and 7). The shredding cutter 26 is preferably cylindrical in its overall outline, having a number of cutter teeth 27. The actual shape of the moving cutting edges 28 on the cutter teeth 27 of the rotating shredding cutter 26, and the matching stationary cutting edge 30 of the guide plate 32, while they could be straight lines, are preferably so shaped that they form a sawtooth-like profile, when viewed in a plane which is perpendicular to the path of relative cutting edge movement. This sawtooth-like cutting profile is preferably defined by a regular zigzag line resembling the outline of a common thread profile, as shown in FIG. 7.

Figure 3:
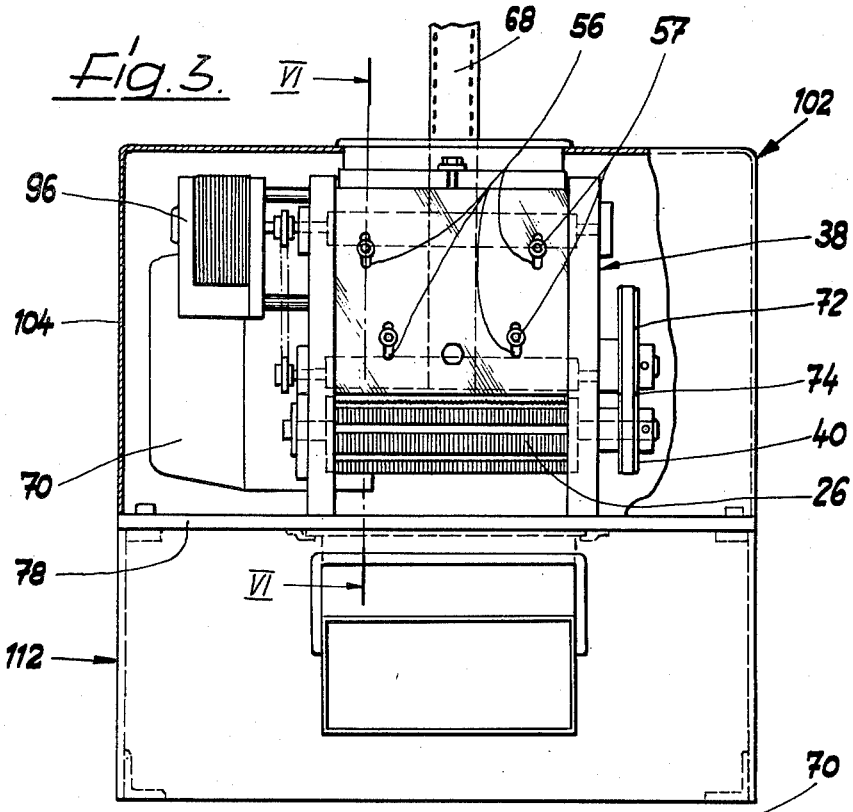
FIG. 3 is a front end view of the device of FIG. 1.

The shredding cutter 26 may thus be a commercially available plain milling cutter, fabricated of tool steel and hardened, much like conventional milling cutters. The cutting faces 29 of the cutter teeth 27 may be radially oriented, or slightly undercut, and extend preferably parallel to the rotational axis of the cutter in the longitudinal sense (FIG. 3). As is common in the manufacture of milling cutters, the peripheral face of the teeth 27 are preferably undercut, along the outline of a logarithmic spiral, for example. The use of a conventional milling tool to serve as the shredding cutter 26 has the advantage that it also greatly simplifies any later sharpening that may be necessary, should the cutting edges 28 of the cutter teeth 27 become dull. In this case, the cutting faces 29 of the shredding cutter 26 can be reground like the cutting faces of any other plain milling cutter, using conventional grinding equipment.

The stationary cutting edge 30 is constituted by the lower edge of a stationary cutting member or guide plate 32. Rather than being hardened like the teeth 27 of the shredding cutter 26, the stationary cutting edge 30 is preferably of much lesser resistance, the plate 32 being fabricated of a material like copper, bronze, or brass, for example. This choice of materials offers two distinct advantages: On the one hand, the combination of the hardened, smoothly ground tool steel of the cutter teeth 27 with the soft copper-based metal of the stationary guide plate 32 gives a good paring for sliding friction at the cutting edges. On the other hand, the hardened shredding cutter 26 can be conveniently used to produce an exactly matching edge shape on the stationary cutting edge 30, by machining the latter, as the guide plate 32 is advanced towards the shredding cutter 26. This machining operation can be readily repeated, whenever the stationary cutting edge 30 has worn dull.

Like other plain milling cutters, the shredding cutter 26 has a central mounting bore with which it is seated on its spindle. In the case at hand, the spindle is a transversely extending cutter shaft 34. Because of the considerable axial length of the shredding cutter 26, the latter is actually not a single milling cutter, but is preferably composed of three axially adjoining milling cutters. While it is, of course, possible to produce a one-piece shredding cutter, the use of several standardized cutters simplifies the construction of the device, reducing its manufacturing cost accordingly. The cutter shaft 34 is journalled near both axial ends of the shredding cutter 26 by means of two ball bearings 36 which are seated in a frame 38 (FIGS. 3 and 5), the shaft reaching axially beyond the latter. On one of the protruding extremities of the cutter shaft 34 is mounted a V-belt pulley 40, being fixedly connected to the shaft 34 by means of a cross pin 42. The inner race of the associated ball bearing is thus axially confined between the shredding cutter 26 and the pulley 40. On the opposite extremity of the cutter shaft 34 is provided a threaded length portion 46 on which is seated a clamping nut 48 which axially clamps the inner race of the other ball bearing against the shredding cutter 26, using an intermediate spacer sleeve 44. The entire shredding cutter assembly is thus axially clamped on the cutter shaft 34, the clamping action being provided by the nut 48 and the pin 42. Two positioning flanges 50, arranged on opposite outer sides of the frame 38, serve to axially position the outer races of the ball bearings 36 in relation to said frame.

Figure 4:
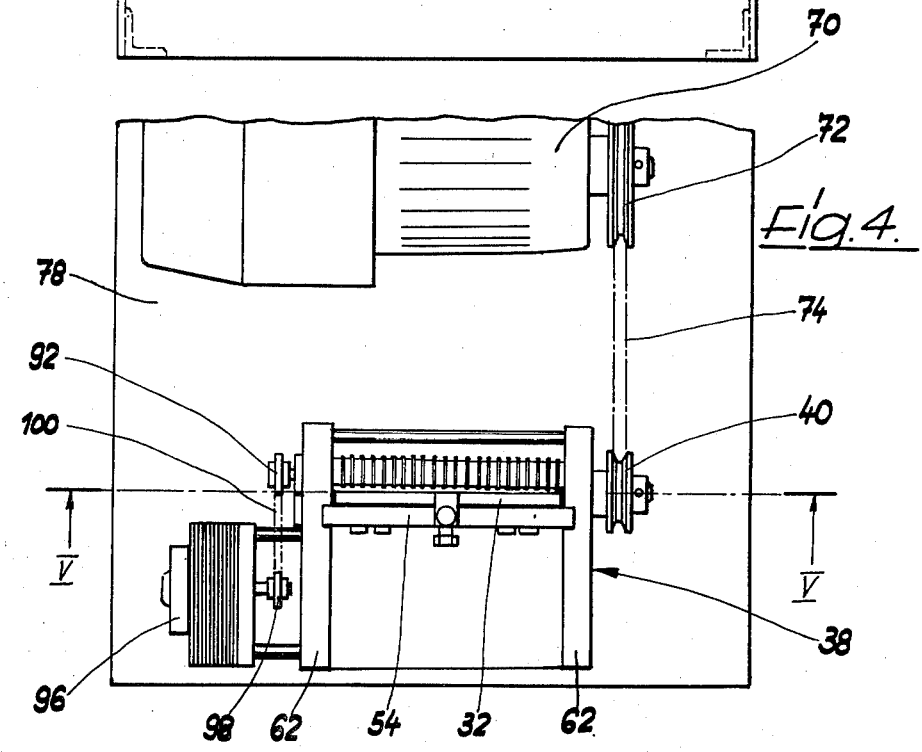
FIG. 4 shows a portion of the device of FIG. 1 in a plan view.

As can be seen in FIG. 4, the frame 38 has a generally H-shaped configuration, when seen from above. This shape is constituted by two laterally spaced, generally upright frame members 62 and a transversely extending, also generally upright cross member 54. On the inner side of this cross member 54 is mounted the earlier-mentioned stationary cutting member or guide plate 32 whose lower edge serves as the stationary cutting edge 30 (see also FIG. 6). The guide plate 2 is vertically adjustable in relation to the cross member 54, being clampable to the latter, following an adjustment operation. In order to provide this adjustability, the cross member 54 of the frame 38 has four vertically extending slots or oblong bores 56, for the accommodation of a corresponding number of clamping bolts 57 whose heads engage the cross member 54 from the outer side and whose threads engage matching threaded bores 58 of the guide plate 32 on the opposite side of the cross member 54. In view of the need for the guide plate 32 to be held rattle-free against the cross member 54 during the vertical advancement of the guide plate against the shredding cutter 26, the clamping bolts 57 are preferably left slightly, tightened, while the edge cutting adjustment takes place. In order to provide a fine-adjustment for this edge cutting operation, there is preferably arranged a horizontal bracket 59 on the upper edge of the guide plate 32, the bracket reaching over the upper edge of the cross member 54. As can be seen in FIG. 6, this configuration conveniently accommodates a central adjusting bolt 60 by means of which the guide plate 32 can be forcibly and slowly advanced downwardly towards the shredding cutter 26. The adjusting bolt 62 engages a matching threaded bore 61 in the upper portion of the cross member 54.

The two upright frame members 62 of the frame 38 have axially aligned bearing seats 64 for the earlier-mentioned ball bearings 36 of the cutter shaft 34. The position of the rotational axis of the shredding cutter assembly is preferably arranged in vertical alignment with that side of the guide plate 32 which faces away from the cross member 54 and whose lower edge serves as the stationary cutting edge 30 (FIG. 3). This arrangement of the shredding cutter 26 means that an appropriate vertical recess or cutout 66 must be provided in the lower portion of the cross member 54 to accommodate the shredding cutter 26. This recess 66 extends preferably from a point just above the level of the cutting edges 28 and 30 all the way down to the base plane of the frame 38.

Figure 2:
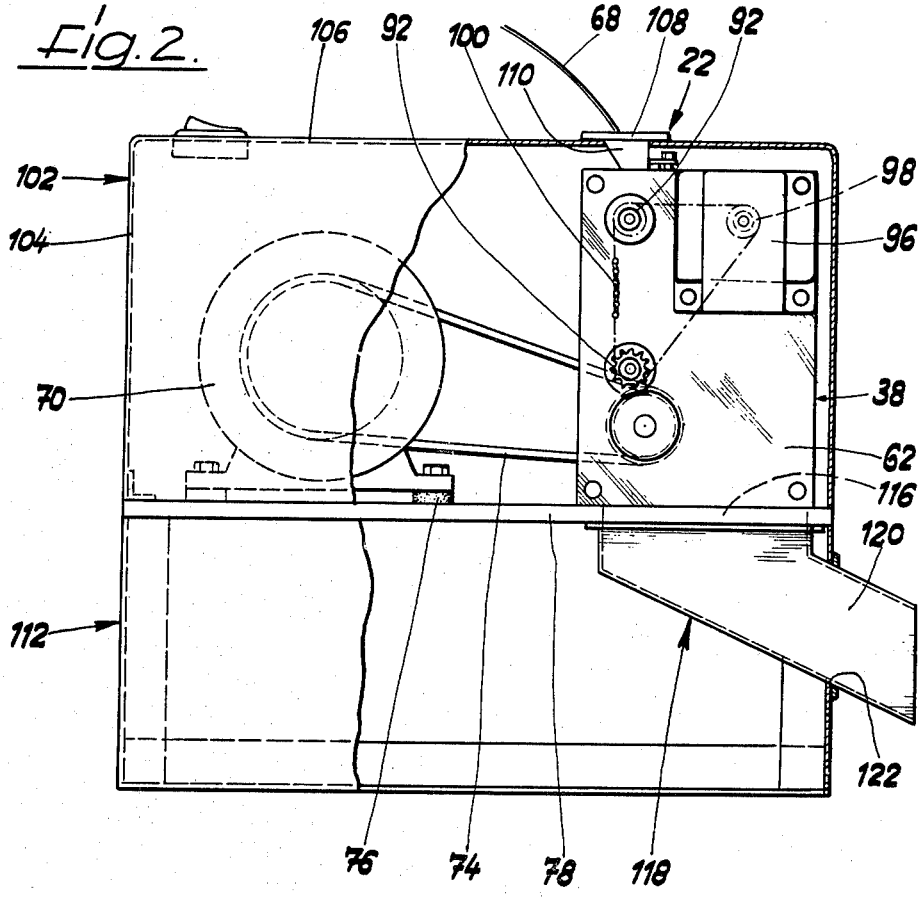
FIG. 2 shows the device of FIG. 1, as seen in an elevational side view, with a portion of the hood cut away.

The material which is to be shredded by the device is represented in an exemplary manner by a microfilm strip 68 which can be seen in FIGS. 1–3. In FIG. 6, the uncut strip 68 is indicated by dotted lines, for better visual distinction. As can be seen in this figure, the uncut strip 68 is fed downwardly, along the guide plate 32, until it reaches the cutting point, where the moving cutting edges 28 of the shredding cutter 26 meet the stationary cutting edge 30 of the guide plate 32. While the guide plate 32 positions the arriving uncut strip 68, those portions of the upright frame members 62 which face the narrow edges of the strip 68 serve as its lateral guides. In order to prevent the possibility that strip material which is being fed against one of these lateral guide portions of a frame member 62 may perhaps escape the axial extremity of the shredding cutter 26, the latter is preferably extended in both axial directions so as to reach a short distance into the larger bearing seats 64 which accommodate the ball bearings of the cutter assembly 34 in the frame members 62 (see FIG. 5). The guide plate 32 and the associated lateral guide portions of the frame members 62 thus form a stationary portion of the strip intake unit 22, in extension of the guide funnel 110, of which the lower extremity is shown in FIG. 6.

The drive for the shredding cutter 26 is provided by means of an electric motor 70 (FIG. 4). A drive pulley 72, mounted on the drive shaft of the motor 70, and larger in diameter than the pulley 40 on the cutter shaft 34, is connected to the said smaller pulley by means of a V-belt 74. The motor 70 is preferably mounted on a base plate 78, using vibration-absorbing elastic spacers 76. The earlier-mentioned frame 38 is likewise bolted to the base plate 78.

A controlled speed of advance of the uncut strip 68 towards the cutting point is assured by means of the strip feeding unit 24 of the device. This speed of advance, in combination with the number of teeth and speed of rotation of the shredding cutter 26 determines the width of the shreds which are produced by the device. While it would be possible to adjust the rotational speed of the shredding cutter 26, it is preferable to provide adjustments, if desired, in the speed with which the uncut strip 68 is fed to the cutting point, as the latter speed is much slower and requires a gear drive in any case.

The strip feeding unit 24 consists essentially of a conveyor with an endless conveying member 80 which is guided on two vertically spaced parallel guide rolls 82, so as to form two vertical runs of which one extends at a close distance from the face of the guide plate 32 to a point which is located near the stationary cutting edge 30 of the latter. As can best be seen in FIG. 5, the conveying member 80 consists actually of a number of endless belt members 84 which are arranged side by side on the two guide rolls 82. A preferred shape of the endless belt members 84 is round, the belt members being simply rubber O-ring belts. Some of these belts are shown in FIG. 5.

Figure 5:
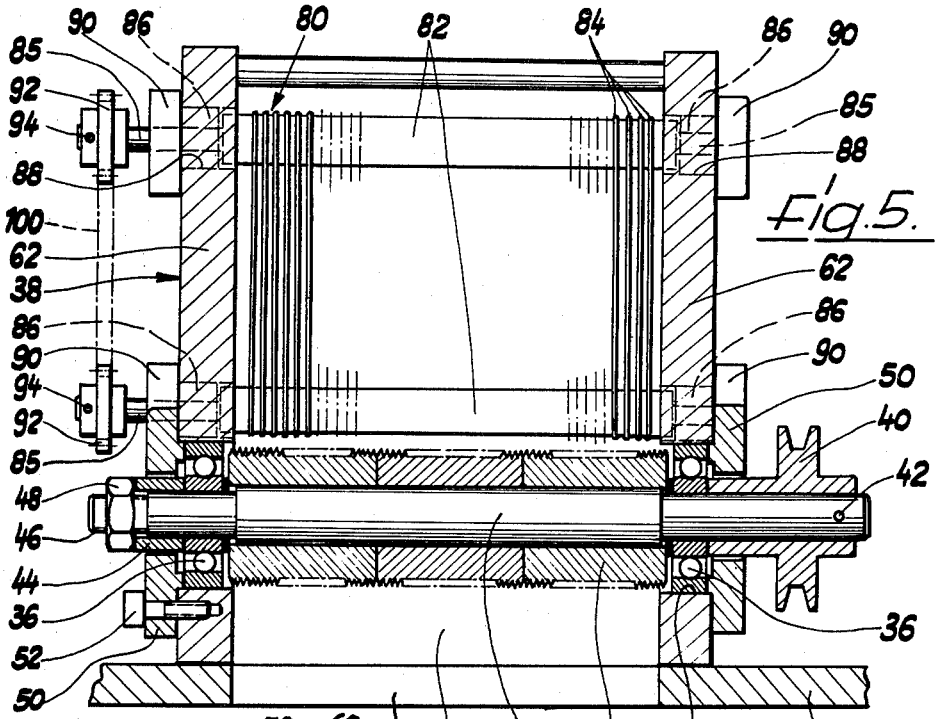
FIG. 5 is a vertical transverse cross section through the device of FIG. 1, as taken along the V—V of FIG 4.

As can also be seen in FIG. 5, the guide rolls 82 of the strip feeding unit 24 reach a short distance into the upright frame members 62, much like the shredding cutter 26, each guide roller having a bearing trunnion 85 on each axial extremity engaged by a suitable journal bushing 86 which is seated in the respective frame member 62. The two journal bushing 86 have flanges 90 by means of which they are removably mounted in the frame members 62, using appropriate clamping bolts. The trunnions 85 on one axial side of the guide rolls 82 extend a distance beyond their journals, having chain sprockets 92 mounted thereon by means of pins 94. In alignment with these two chain sprockets 92 is arranged a third chain sprocket 98 (see FIG. 2) which is mounted on the drive shaft of a gear motor 96 which can be seen in FIGS. 3 and 4. The motor 96 is likewise mounted on the upright frame member 62, on the same side on which the strip feeding unit drive is arranged. A link chain 100 connects the motor sprocket 98 with the two guide roller sprockets 92. The strip feeding unit drive and the earlier-described V-belt drive for the shredding cutter 26 are preferably arranged on opposite sides of the frame 38.

FIGS. 1, 2 and 3 further show that the preferred embodiment of the device includes a protective cover in the form of a hood 102. The side walls 104 of the hood reach downwardly to the base plate 78 to which they are attached by means of suitable screws (not shown). As can best be seen in FIG. 2, the top wall 106 of the hood 102 includes an intake opening 108 which leads to a guide funnel 110. The lower end portion of the latter can be seen in FIG. 6, reaching downwardly to a point next to the guide roll 82 of the strip feeding unit 24, where its conveying member 80 forms an intake gap with the guide plate 32 of the strip intake unit 22. The arriving uncut strip 68 is thus safely guided into said intake gap, where the moving conveying member 80 engages the strip 68, advancing it downwardly towards the cutting point, at a controlled speed.

In FIGS. 1, 2 and 3, the device of the invention is further shown to include a trough-shaped base 112 which carries the base plate 78. The latter is bolted to the side walls 114 of the base 112. Underneath the cutting point is arranged an outlet opening 116 in the base plate 78. This outlet opening leads to an outlet chute 118 which is attached to the base plate 78. The chute 118 includes an inclined outlet duct 120 of rectangular cross section, the duct 120 leading to the outside of the device, through a wall aperture 122 in the front side wall of the base 112. To the protruding extremity of the outlet duct 120 can be attached a suitable waste bag or other container, intended to receive the data carrier shreds. Suitable clamping means may be provided to attach the waste bag to the mouth of the outlet duct 120.

As an alternative to the low base 112 which is shown in the drawings, the device may be provided with a modified base which is tall enough to accommodate a waste container directly underneath the chute 118. In this case, the oblique outlet duct 120 could be replaced with a simple vertical funnel. The base in this case would preferably be provided with a removable side wall, or with a suitable door in one of the side walls.

A second embodiment of the invention is illustrated in FIGS. 8 through 12. This embodiment features a somewhat modified shredding arrangement and an extensively modified strip feeding unit for the microfilm or other data carrying material which is to be shredded. Other portions of this embodiment of the invention are identical with, or similar to, corresponding parts and components of the previously described embodiment. Reference should therefore be had to the latter for those components and characteristics of this embodiment which are not specifically described hereinbelow.

The shredding assembly of this device is again formed by a shredding cutter 126 which has the form of a plain milling cutter, and which cooperates with two stationary cutting edges 128 and 130. As in the previously described embodiment, the shredding cutter 126 has a number of cutting teeth on its circumference, each forming a moving cutting edge 132. While the general shape of the cutting teeth is substantially unchanged from the prior embodiment, the orientation of the cutting faces in the axial sense is shown to be inclined in relation to the rotational axis of the cutter shaft 148. This inclination, i.e. the helix angle of the cutter teeth flutes, is approximately five degrees (see FIG. 11). It should be understood, of course, that the shredding cutter of the previously described embodiment could be similarly helically fluted. The advantage of such a helically fluted shredding cutter over a straight fluted shredding cutter is that it executes its cutting action in a scissors motion, progressing from one side to the other, thereby providing a smoother and quieter operation. The actual cutting profile of the moving cutting edges 132 and of the two stationary cutting edges 128 and 130 is again preferably zig-zag-shaped, using a regular thread profile, for example.

As in the previously described embodiment, the decive of FIGS. 8—13 includes a guide plate 134 whose lower forward edge serves as a stationary cutting edge 128, the guide plate 134 being again adjustably clamped to a vertical cross member 136 of a main frame 138. The same main frame also carries a second plate 140 which, like the guide plate 134, extends against the shredding cutter 126, thereby serving as a second stationary cutting edge 130, at a second cutting point which is 90 degrees offset from the first cutting point at the stationary cutting edge 128. In the sense of shredding cutter rotation, the second cutting point is thus located one-quarter revolution behind the first cutting point.

The second plate 140 is oriented horizontally, being supported by a horizontal cross member 142 of the main frame 138. Because of the horizontal plate 140 does not have to perform a guiding function like the vertical plate 134, it is much shorter in the radial direction than the latter. However, like the guide plate 134, it is adjustable in the radial sense, capable of being advanced towards the shredding cutter 126, for the establishment of a precisely matching second stationary cutting edge 130, through a machining action by the shredding cutter 126.

Between the two cutting points, defined by the first and second stationary cutting edges 128 and 130 and by the moving cutting edges 132 of the shredding cutter 126, is arranged a guide cover 144 which forms an enclosed space with the periphery of the shredding cutter 126 and the lower extremity of the vertical cross member 136. The guide cover 144 is preferably a sheet metal cover extending transversely between the upright members 150 of the main frame 138 and being removably attached to the lower rear edge of the vertical cross member 136 by means of clamping screws. The cross-sectional shape of the guide cover 144 is such that it forms a rounded flow chamber 146 (FIG. 13) with the lower end face of the cross member 136, the chamber producing a whirling action on the shreds which are carried into the chamber by the teeth of the shredding cutter 126. As an alternative to the guide cover just described, the latter may also be modified, so as to take the place of the second cross member 142, if the guide cover is designed to be strong enough and so shaped that the second plate 140 can be adjustably clamped to it.

Figure 11:
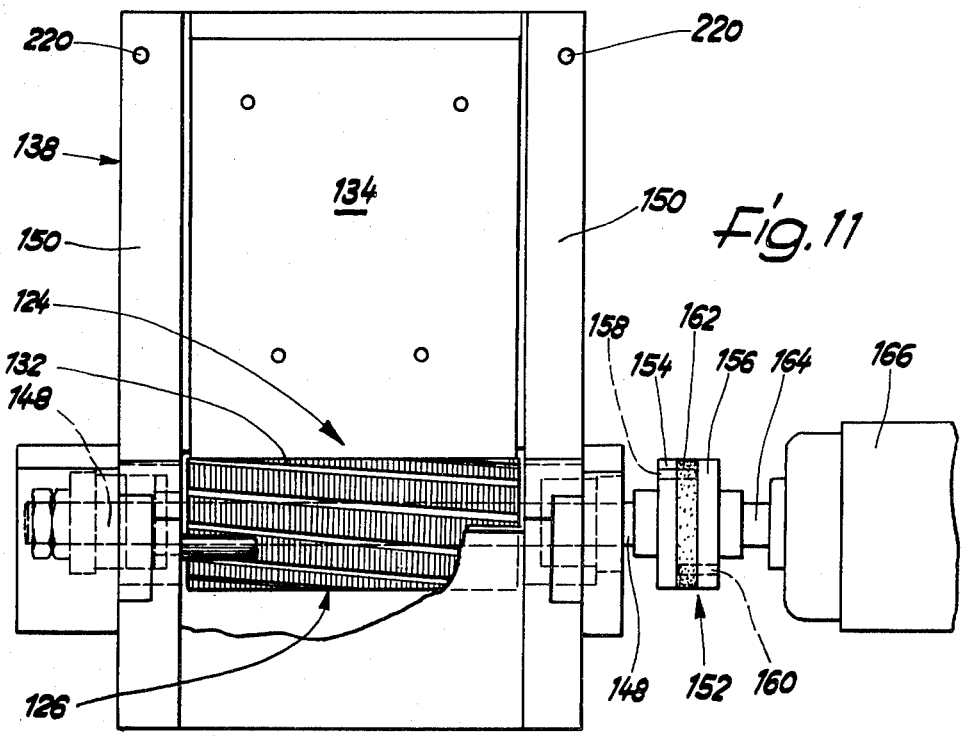
FIG. 11 shows the rear portion of the device of FIG. 8, as seen along arrow XI of FIG. 10.

As can be seen in FIG. 11, the shredding cutter 126 is mounted on a cutter shaft 148. As in the previously described embodiment, the cutter shaft 148 is journalled in the two upright frame members 150 of the main frame 138 by means of suitable ball bearings. The drive for the shredding cutter is again provided by an electric motor 166, but the V-belt drive of the first embodiment is replaced by an elastic coupling 152 connecting an extremity of the cutter shaft 148 with the axially aligned drive shaft 164 of the motor 166. The elastic coupling 152 is of the elastic-disc type, having two flanged coupling members 154 and 156 fixedly mounted on the extremities of the shafts 148 and 164, respectively, and an elastic coupling disc 162 arranged axially between the coupling members 154 and 156. The elastic coupling disc 162 has four regularly spaced bores near its periphery. Engaging these bores are matching coupling pins 158 and 160 which are solidary with the flanges of the coupling members 154 and 156, respectively, the two pairs of pins being angularly offset by 90 degrees. The electric motor 166 and the main frame 138, which carries the various operating components of the device, are mounted on a common base plate which is not shown in the figures relating to this embodiment.

Figure 8:
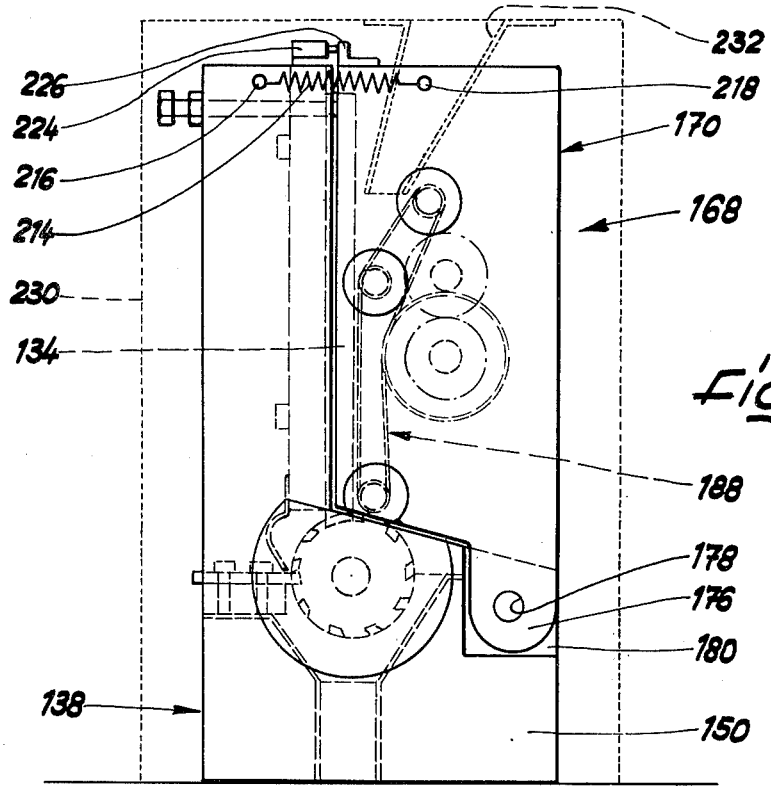
FIG. 8 shows a second embodiment of the invention, as seen in an elevational side view.
Figure 9:
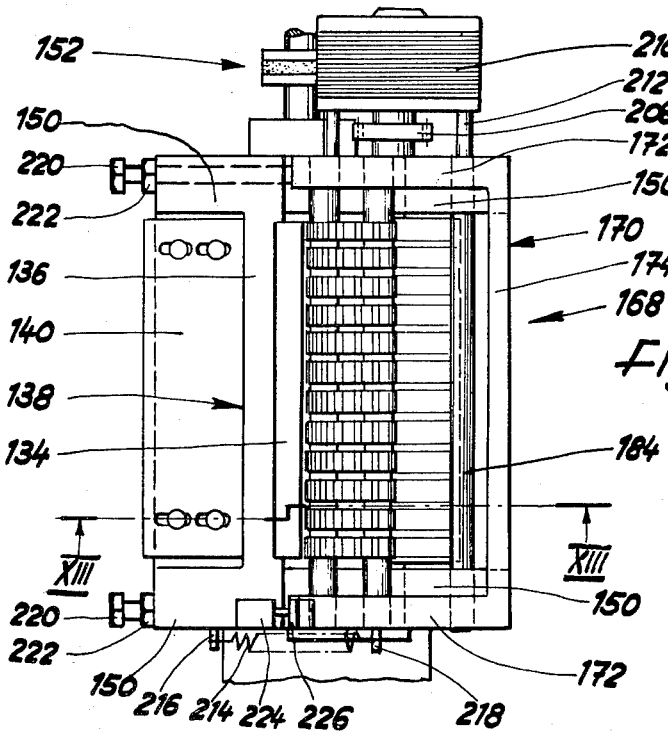
FIG. 9 shows the lower portion of the device of FIG. 8 in a plan view.
Figure 10:
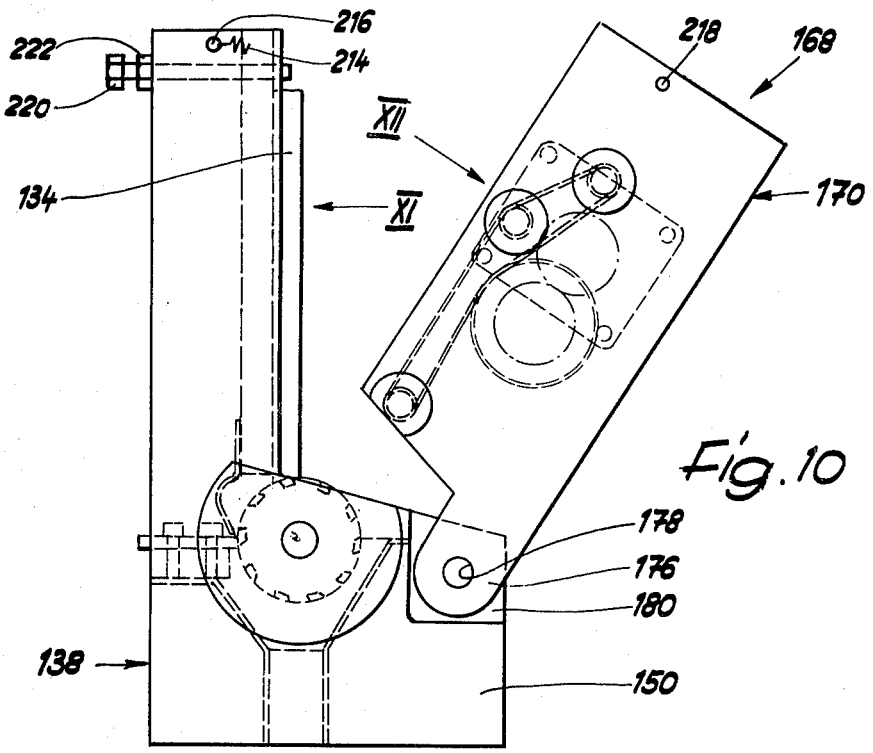
FIG. 10 shows the embodiment of FIG. 8, with a portion thereof pivoted out of position.
Figure 13:
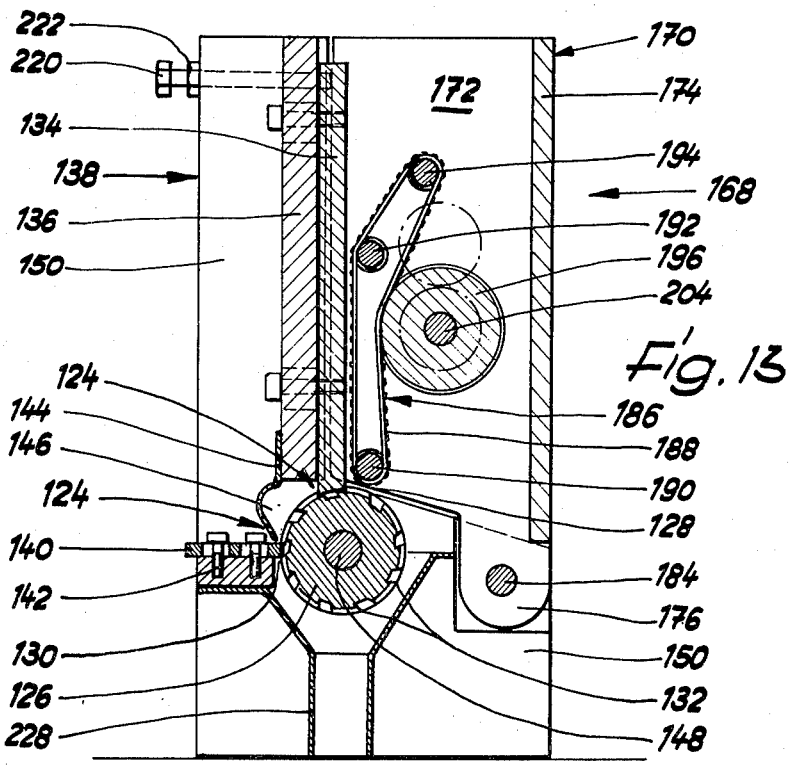
FIG. 13 is a longitudinal cross section through the device of FIG. 8, as taken along line XIII—XIII of FIG. 9.

The strip feeding unit 168 of this embodiment, as shown in FIGS. 8, 10, and 13, differs from the strip feeding unit of the previously described embodiment in that it forms a self-contained subassembly. For this purpose, the unit has its own pivot frame 170 which has a generally U-shaped cross section, as can be seen in FIG. 9. The pivot frame 170 thus consists of two lateral frame portions 172 and a transverse frame portion 174 which joins the frame portions 172 on the front side of frame 170. The lateral frame portions 172 have ear extensions 176 on their lower extremities with aligned pivot bores 178 arranged therein. Appropriate cutouts in the upright frame members 150 of the main frame 138 accommodate the lateral frame portion 172 of the pivot frame 170, so that, together, the main frames 138 and the pivot frame 170 form a compact assembly. In the area of the ear extensions 176 of the lateral frame members 172 are arranged appropriate recesses 180 in the upright frame members 150 of the main frame 138, so that the narrower ear extensions 176 fit into the recesses 180, while being outwardly aligned with the upright frame members 150. The latter have pivot bores 182 in alignment with the pivot bores 178 of the ear extensions 176, accommodating therein a pivot shaft 184 which defines a horizontal pivot axis for the pivot frame 170 of the strip feeding unit 168 in relation to the main frame 138 and the units which are carried by the latter.

Figure 12:
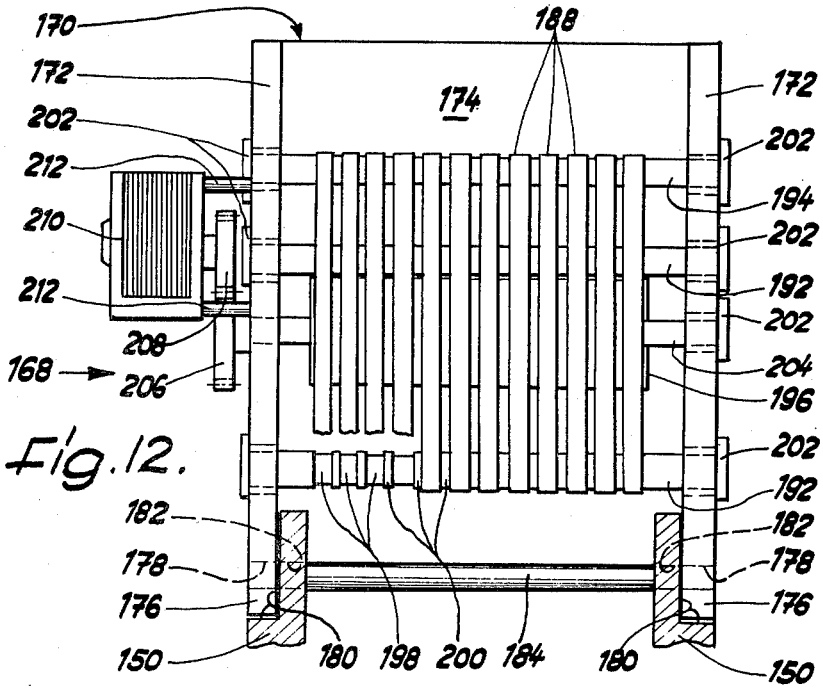
FIG. 12 shows the pivotable front portion of the device of FIG. 8, as seen along arrow XII of FIG. 10.

Details of the strip feeding unit 168 can be seen in FIGS. 12 and 13. The unit itself is again in the form of a vertical conveyor, consisting essentially of an endless conveying member 186 which preferably takes the form of a plurality of endless timing belts 188 arranged side by side between the lateral frame portions 172 of the pivot frame 170. These timing belts 188, rather than having their teeth facing inwardly, as is commonly the case, are turned inside out, as can best be seen in FIG. 13. Three parallel guide rolls 190, 192, and 194 support and guide the timing belts 188. The three guide rolls are spaced at unequal distances from the first cuttig point at the periphery of the shredding cutter 126. In a first portion of the timing belt run, defined by the near guide roll 190 and the intermediate guide rolls 192, the timing belts 188 extend parallel to the forward surface of the vertical guide plate 134, forming a small conveying gap therewith through which the uncut strip (not shown) is advanced downwardly towards the cutting point. A second portion of the timing belt run, defined by the intermediate guide roll 192 and the distal guide roll 194, extends at an obtuse angle to the first conveyor run portion, i.e. upwardly and away from the guide plate 134, thereby forming a funnel-like entry to the earlier-mentioned conveying gap between the first conveyor run portion and the guide plate 134.

Unlike in the previously described embodiment, where the two guide rolls of the strip feeding device are both driven, the three guide rolls 190, 192 and 194 of this embodiment are idling rolls. The drive for the timing belts 188 is provided by means of a drive drum 196 which engages the outer side of the timing belts i.e. their toothed side. For this purpose, the center of the drive drum 96 is so located between the near guide roll 190 and the distal guide roll 194 that the return run portion of the timing belts between these two guide rolls is deflected inwardly towards the other two portions of the belt run, thereby providing a certain deflection of the timing belts around the drive drum 196.

The guide rolls 190, 192, and 194 are of comparatively small diameter. As can be seen in FIG. 12, each roll has on its periphery a series of shallow grooves 198, forming intermediate narrow collars 200 for a positive lateral guidance of the timing belts 188. The axial extremities of each guide roll are journalled inside flanged journal bushings 202 which are received in appropriate bores of the lateral frame portions 172 of the pivot frame 170. The drive shaft 204 which carries the drive drum 196 has preferably the same diameter as the guide rolls, so that identical journalled bushings can be used for its support in the pivot frame 170. One axial end portion of the drive shaft 204 extends beyond the associated lateral frame portion 172, carrying on its protruding extremity a first gear 206 which is engaged by a second gear 208 mounted on the drive shaft of the gear motor 210. The latter may be the same motor as has been suggested in connection with the first embodiment, being again mounted in a cantilever fashion on the pivot frame 170 with the aid of spacer studs 212.

FIGS. 8 and 9 show the pivotable strip feeding unit 168 in its normal operating position. It is maintained in this position by means of two tension springs 214, of which only the spring on one side of the device is shown in FIG. 9. Both the main frame 138 and the pivot frame 172 have appropriate laterally extending anchor pins 216 and 218, respectively, with spring positioning grooves engaged by the rounded end hooks of the tension springs 214. Two abutment bolts 220, arranged in the upper end portions of the upright frame members 150, serve as adjustable stops which counteract the bias of the tension springs 214 so as to establish an adjustable spacing between the main frame 138 and the pivot frame 170, thereby making it possible to adjust the conveying gap between the guide plate 134 and the endless belt member 186. The two abutment bolts 220 are secured by means of counter nuts 222.

In FIGS. 8 and 9 is further shown a position switch 224 which is mounted on top of the main frame 138. A cooperating actuating bracket 226 is arranged on top of the pivot frame 170, in alignment with the switch 224. The position of the bracket 226 is preferably adjustable in the direction of switch actuation. The position switch 224 acts as a safety switch, responding when the strip feeding unit is pivoted away from its normal operating position, as when more than one layer of data carrier are accidentally fed between the endless conveyor member 186 and the guide plate 134, or when the strip feeding unit is pivoted out of place as the result of the accidental entry of some other object into the device. Such a pivoting motion of the strip feeding unit causes the position switch 224 to interrupt an electrical circuit, which may be the circuit for the gear motor 210 of the strip feeding unit 168, or which may be a circuit which also controls the motor 166 driving the shredding cutter 126, thereby shutting down either the strip feed alone, or the entire device.

As an alternative to the simple safety cutoff feature of the position switch 224, the latter may be a three-stage switch whose first stage is again closed, for normal operation of the device, when the pivot frame 170 of the strip feeding unit is in its normal position relative to the main frame 138, and whose third stage is similarly open, interrupting an operational circuit which controls either the strip feeding unit alone, or the entire device. Between these two end stages, the three-stage switch has a second, intermediate stage which it will reach after a very small movement of the pivot frame 170 away from the main frame 138, whereby the drive of the strip feeding unit is switched from its normal circuit to a different circuit so as to run at half-speed, for example. The small pivoting movement which shifts the switch to its intermediate switching stage may be indicative, for example, of two or three layers of data carriers being fed into the device simultaneously. In such a case, the automatic slowdown of the strip feeding unit works to compensate for the feed-in of multiple layers, so that the shredding operation can continue at the reduced speed. The device automatically switches back to full speed, as soon as the multiple-layer material has been shredded. But, whenever more than the permissible two or three superposed layers of data carriers are fed into the device, the position switch 224 responds by shutting down the device, in order to prevent the possible blocking of the shredding cutter which could lead to a burnout of the drive motor 166 or some other damage.

FIG. 13 further shows that this embodiment of the device includes a funnel-shaped outlet chute 228 for the shredded material, the chute 228 having a vertical outlet portion. The base plate of the device (not shown), on top of which the main frame 138 would be supported, has an appropriate aperture for the outlet chute 228, so that the shredded material falls through it into a suitable receptacle. The latter may be a solid container, or a special attachable bag, for example.

In FIG. 8 is further shown a hood-like protective cover 230, indicated by dotted lines. The top panel of the cover 230 carries an inclined guide funnel 232 through which the uncut strip is guided onto the inclined belt run portion of the strip feeding unit 168 which leads to the conveying gap at the guide plate 134.

A third embodiment of the invention is illustrated in FIGS. 14 through 17. This embodiment is a modification of the previously described embodiment, differing therefrom primarily in the arrangement of the movable self-contained strip feeding unit in relation to the remainder of the device, and by the construction of the strip feeding unit itself. In all other respects, the details of this embodiment are identical with, or similar to, the details of the previously described embodiment. Reference should therefore be had to the foregoing description for those components and characteristics of this embodiment which are not specifically described hereinbelow.

Figure 14:
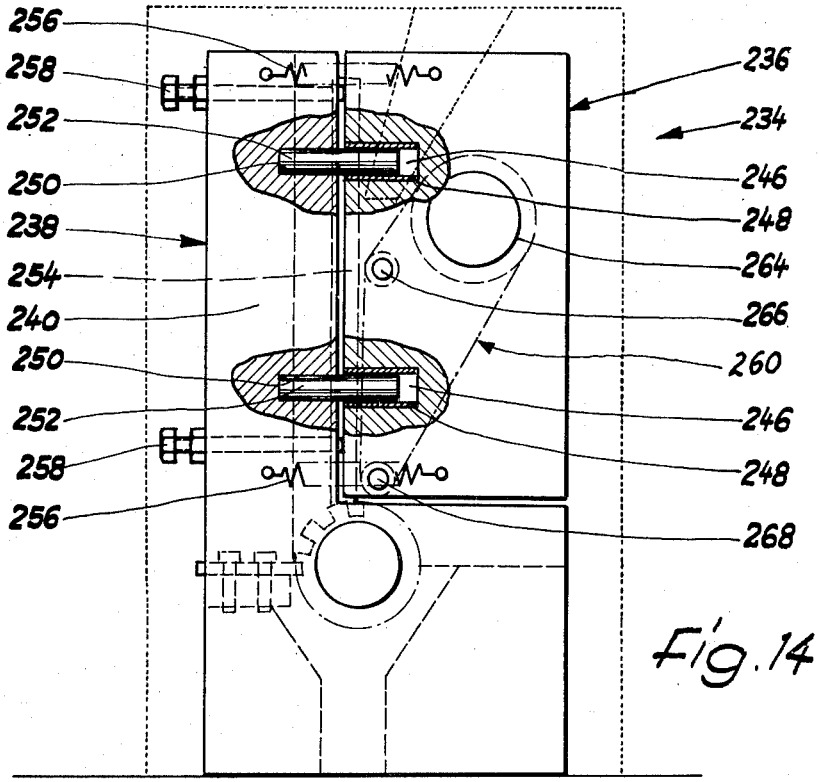
FIG. 14 shows a third embodiment of the invention, as seen in an elevational side view with portions thereof cross-sectioned.
Figure 15:
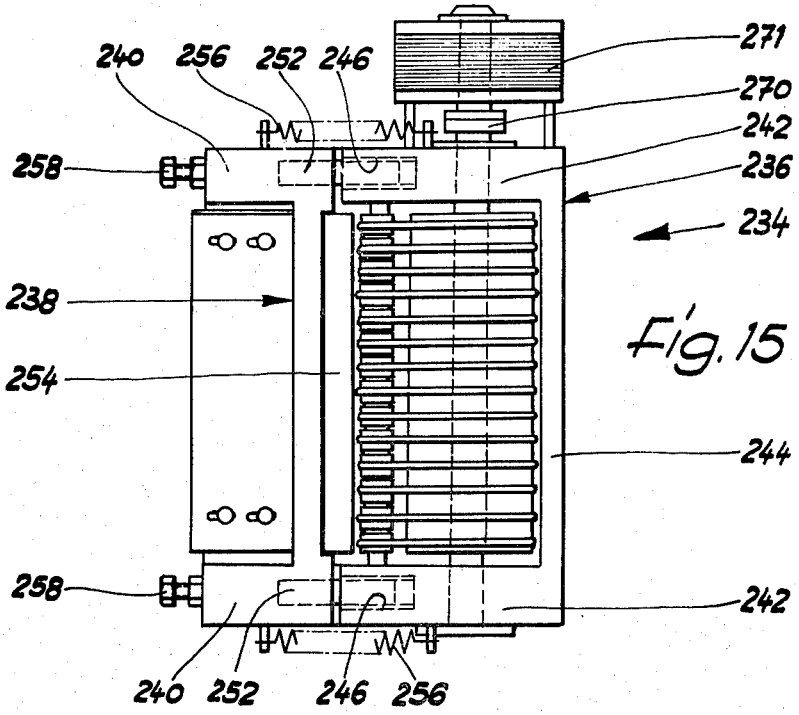
FIG. 15 is a plan view of the device of FIG. 14.

Referring to FIGS. 14 and 15, it can be seen that this embodiment has a self-contained strip feeding unit 234 which is similar to that of the second embodiment. Again, the components of the strip feeding unit are mounted inside a separate movable frame 236 of U-shaped outline (see FIG. 15). FIG. 14 shows that the elevational outline of the movable frame 236 is rectangular, with vertical and horizontal lines matching parallel vertical and horizontal lines of a recess in the upright frame members 240 of the stationary main frame 238.

Unlike the profile of the pivot frame 170 (FIG. 9) of the previous embodiment, the movable frame 236 has lateral frame portions 242 which are approximately twice as heavy as the transverse frame portion 244 which joins the lateral frame portions at their forward edge. The lateral frame portions 242 are heavier, because each of them accommodates two vertically spaced blind bores 246 which extend horizontally and parallel to each other and are open towards the adjacent forward end faces of the upright frame members 240 of the main frame 238. The vertical spacing of the blind bores 246 is preferably greater than their respective distances from the upper and lower extremities of the movable frame 236. Inside each blind bore is seated a guide bushing 246 of a suitable homogeneous bearing metal or of composite construction. In the latter case, the wall of the guide bore of a guide bushing 248 is formed by a layer of, or at least embedded particles of polytetrafluoroethylene, in order to give the bushing good dry-friction characteristics.

In both upright frame members 240 of the main frame 238 are likewise arranged two vertically spaced blind bores 250, in alignment with the blind bores 246 of the lateral frame portions 242 of the movable frame 236. In the four blind bores 250 are seated four guide pins 252 of hardened steel, protruding horizontally from their seating bores and reaching into the guide bores of the guide bushings 248. The four pairings of guide bushings 248 and guide pins 252 thus form a straight-line guide for the movable frame 236 which carries the strip feeding unit 234, so that the latter is displaceable on a path which is substantially perpendicular to the guide surface of the vertical guide plate 254, along which the uncut strip is advanced downwardly towards the shredding cutter.

As in the previously described embodiment, the movable frame 236 is spring-biased towards the stationary main frame 238, using suitable tension springs 256. While the pivot frame 170 of the previous embodiment requires only one spring on each side of its frame, near the upper edge thereof, the straightline mobility of the frame 236 necessitates four tension springs 256 arranged near the upper and lower edges of the lateral frame portions 242 of frame 236. Similarly, the adjustment of the correct guide gap between the guide plate 254 and the strip feeding unit 234 necessitates four stop bolts 258, rather than the previously required two bolts, the stop bolts 258 extending horizontally through the upright frame members 240, not far from the upper and lower extremities of the movable frame 236.

The general outline of the conveyor-type strip feeding unit 236 is given in stippled lines in FIG. 14. Again, the latter is essentially an endless conveying member 260 consisting of a number of identical endless O-ring belts 262 which are arranged side by side on common guide rolls. The endless O-ring belts may be of rubber or of a rubber-like material, such as polystyrene, for example. These belts are shown, at an enlarged scale, in FIGS. 16 and 17, having a comparatively large diameter of approximately 7 mm, so as to offer considerable transverse compressive elasticity.

Figure 16:
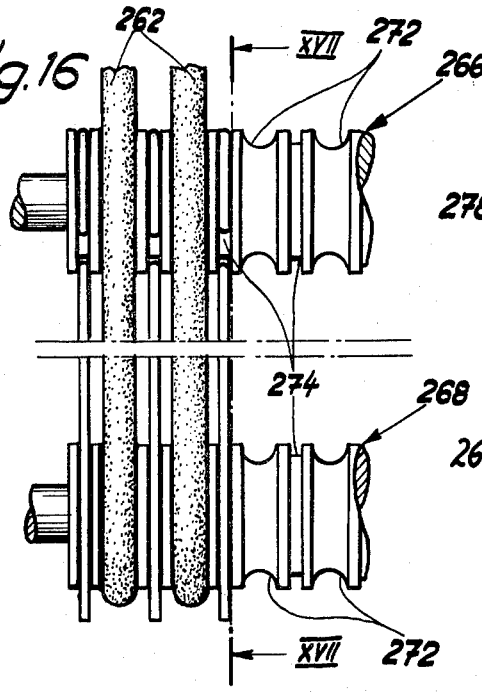
FIG. 16 shows enlarged details of the strip feeding unit of the embodiment of FIG. 14, as seen from the front.
Figure 17:
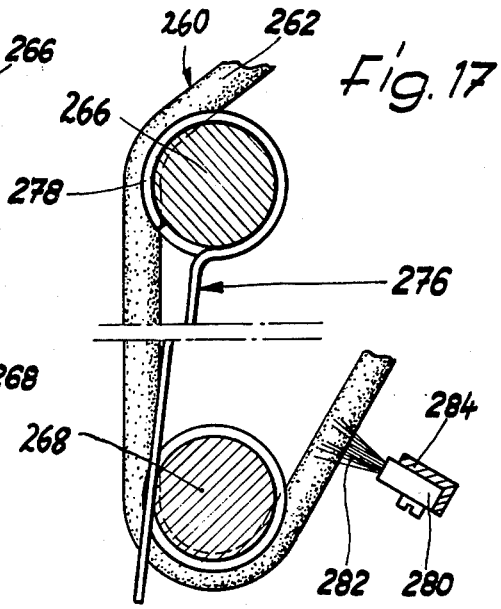
FIG. 17 shows the unit of FIG. 16 in a cross section taken along line XVII—XVII of FIG. 16.

The outline of the conveyor run of the conveying member 260 is generally similar to that of the previously described guide rolls 264, 266, and 268. As can be seen in FIGS. 16 and 17, the near guide roll 268 and the intermediate guide roll 266 are again identical and of comparatively small diameter, while the distal guide roll 264 is much larger in diameter, serving also as a driving member of the unit. For this purpose, the guide roll 264 is directly coupled to an axially aligned drive motor 271, using an elastic coupling 270.

As can best be seen in FIG. 16, the guide rolls 266 and 268 have shallow guide grooves 272 arranged on their peripheries. Similar guide grooves are also arranged on the larger guide roll 264. The profile of the shallow guide grooves 262 is preferably a section of a circle, matching the cross-sectional shape of the endless O-ring belts.

This version of the strip feeding unit further features a means for extending the guide gap, from the point where the endless conveying member 260 returns about its near guide roll 268, closer to the cutting point defined by the stationary and moving cutting edges. This means consists essentially of a series of narrow guide pins 276 which are arranged between the O-ring belts 262, without touching the latter. For this purpose, the two small guide rolls 266 and 268 have arranged on their peripheries a series of positioning grooves 274 of axially narrow rectangular outline which alternate with the previously described shallow guide grooves 272 for the O-ring belts 262. Each of the guide pins 276 has a circular open eye portion 278 with which it engages a positioning groove 274 of the intermediate guide roll 266, so as to be held in place by the latter, without impeding its rotation.

A straight portion of each guide pin 276 extends downwardly from the intermediate guide roll 266 and past the near guide roll 268, engaging a positioning groove 274 of the latter for lateral guidance. These straight portions of the guide pins 276, which may also be slightly kinked or otherwise curved, if necessary, form a downward extension of the guide gap which is defined by the guide plate 254 (FIG. 15) and the cooperating surface portion of the rotating O-ring belts, in their vertical belt run portion between the intermediate guide roll 266 and the near guide roll 268. The guide pins 276 are preferably of spring steel or of some other resiliently yielding material, so that they can be shaped to apply a slight pressure against the uncut strip in the direction of the guide plate 254, in the vicinity of the cutting point. Because of their minimal space requirements, the guide pins 276 can reach almost to the very cutting point itself, thereby preventing unguided end pieces of the data carriers from falling out of control in the space between the lower end of the guide gap and the cutting point.

In FIG. 17 is also shown a device for cleaning the endless conveyor member 260, using an elongated wiper brush 280 which extends transversely to the O-ring belts and engages the latter at their return run portion, just after leaving the near guide roll 268. The natural bristles 282 of the wiper brush 280 are in continuous contact with the rotating belts 262, so as to remove from the latter any shreds and dust particles that may have become attached thereto. The wiper brush 280 is mounted on an L-shaped support bracket 284 which is attached to the lateral frame members 242 of the movable frame 236. This belt cleaning device could, of course, also be used in conjunction with the previously described first and second embodiments of the invention.

Figure 18:
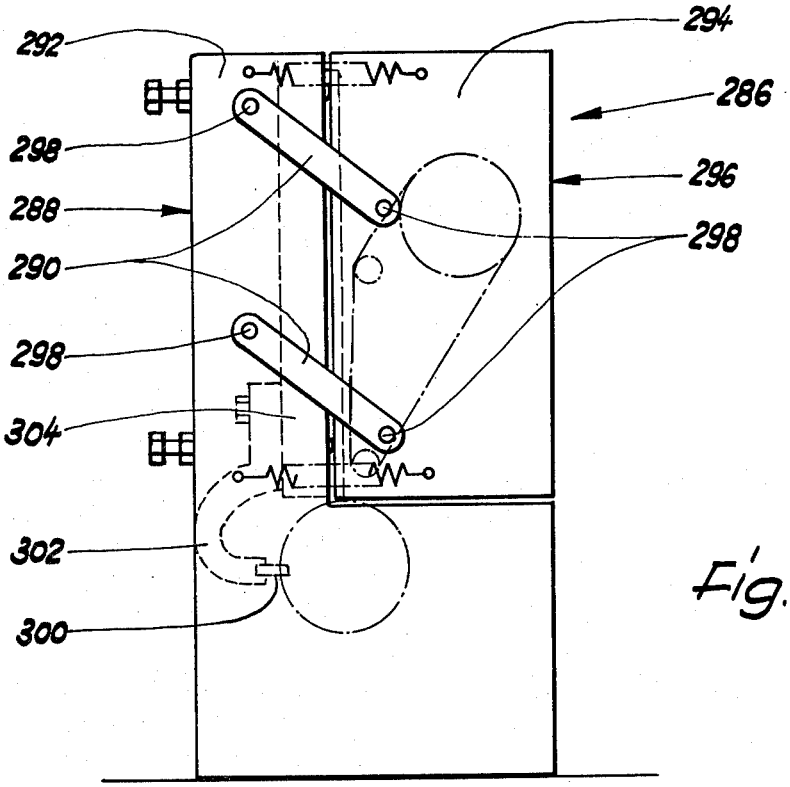
FIG. 18 shows a fourth embodiment of the invention, as seen in an elevational side view.

In FIG. 18 is shown a fourth embodiment of the invention, representing a modification of the previously described third embodiment which is shown in FIGS. 14–17. The proposed modification concerns itself essentially with the manner in which mobility is provided for the self-contained strip feeding unit 286, in relation to the stationary main frame 288 of the device. This embodiment, therefore, suggests the arrangement of a simple parallel linkage between the movable frame 296 and the stationary main frame 288, the parallel linkage consisting of two cooperating pairs of simple links 290 which are arranged on opposite sides of the two frames. For this purpose, the upright frame members 292 of the main frame 288 and the lateral frame portions 294 of the movable frame 296 have aligned lateral faces to which the extremities of the links 290 are pivotably attached by means of suitable pivot connections 298.

As can be seen in FIG. 18, the pivot connections on the upright frame members 292 are located above the associated pivot connections on the lateral frame portions 294 of the movable frame 296, so that the longitudinal axes of the links 290 extend at an angle of approximately 35 degrees from a plane which is perpendicular to the feed direction of the uncut strips. This parallel linkage thus provides a mobility of the strip feeding unit 286 in an upward and outward direction relative to the stationary guide plate of the device. Consequently, the weight of the strip feeding unit assists the tension springs in providing a preload which holds the strip feeding unit in its normal operating position against the stop bolts. The extent to which the weight of the unit contributes to this preload is determined by the choice of the angle of inclination of the parallel linkage.

FIG. 18 also shows, in connection with the fourth embodiment of the invention, a modification of the mounting arrangement for the second stationary cutting edge which has been described in detail in connection with the second embodiment of the invention (FIGS. 8–13). As is shown in dotted lines in the drawing, the stationary cutting edge is provided as part of a short horizontal blade-like plate 300 which is press-fitted into the mouth portion of a hook-shaped support member 302. The latter, by virtue of its curved shape, also fulfills the role of the previously suggested guide cover 144 (FIG. 13). However, because the support member 302 is subjected to the cutting forces at the second cutting point, its wall must be much heavier than that of the guide cover 144. Like the latter, it is removably mounted on the back side of the vertical cross member 304 of the main frame 288, using clamping bolts.

It should be evident from the foregoing description that various components and subassemblies which have been described in connection with a particular one of the four preferred embodiments can in many cases also be used in connection with one or more of the other embodiments, and that various features which are disclosed in connection with different embodiments may also be combined in a way which is not specifically shown in the drawings.

It should further be understood, of course, that the foregoing disclosure describes only preferred embodiments of the invention and that it is intended to cover all changes and modifications of these examples of the invention which fall within the scope of the appended claims.

I claim the following:

1. A shredding device adapted for the destruction of microfilm and similar information carriers with microimage impressions, the device comprising in combination:

a main frame;

a shredding cutter with a power drive, the cutter being rotatably supported by the main frame and having the general shape of a milling cutter with a plurality of angularly spaced longitudinal cutting edges arranged on its periphery;

a first stationary cutting edge supported by the main frame so as to cooperate with the rotating cutting edges of the shredding cutter to define a first cutting position therewith; and a strip feeding unit operable to feed and guide information carrier material to said first cutting position, the strip feeding unit being supported by the main frame and comprising:

a stationary guide plate having a guide surface oriented substantially radially with respect to the shredding cutter and leading to said first cutting position, where the guide plate carries said first stationary cutting edge;

means for forcibly advancing strip material along the stationary guide plate, towards the first cutting position, said strip advancing means including a plurality of rotating strip advancing members and a drive therefor, at least some of said members being arranged side-by-side and spaced apart in a direction transverse to the direction of strip advance, and each of said members forming a strip feed gap with the guide plate; and a feeding unit frame supporting the strip advancing means, including means operable to retract the strip advancing members in a direction away from the guide plate, for access to the strip feeding gaps.

2. A microfilm shredding device as defined in claim 1, wherein the strip advancing means is a strip feeding conveyor, having at least two conveyor guide rolls and a plurality of endless belt members which are supported on the guide rolls and represent said rotating strip advancing members;

the strip feeding conveyor is arranged in such a way that a straight portion of each belt member extends substantially parallel to the guide surface of the stationary guide plate, thereby forming said strip feed gaps; and the drive for the strip advancing members is a conveyor drive.

3. A microfilm shredding device as defined in claim 2, further comprising:

a second stationary cutting edge supported by the main frame so as to likewise cooperate with the rotating cutting edges of the shredding cutter, thereby defining a second cutting position which is located a distance behind the first cutting position in the sense of cutter rotation; and cover means forming an enclosure between the first and second cutting positions for the conveyance of the cut information carrier shreds from the first to the second cutting position, the shape of said enclosure bulging outwardly to allow for the intermingling of the shreds during conveyance.

4. A microfilm shredding device as defined in claim 2, wherein the strip feeding conveyor has at least three guide rolls arranged at unequal distances from the first cutting position;

the gap-forming straight belt member portions extend between a first, nearest guide roll and a second guide roll of intermediate spacing; and adjoining inclined belt member portions extend from the second guide roll to a third, more distant, guide roll, at such an angle to the guide surface of the guide plate that the inclined belt member portions move towards the guide surface in a converging sense.

5. A microflim shredding device as defined in claim 4, wherein the endless belt members further include return portions extending between the first and third guide rolls; and the conveyor drive includes a drive member engaging the return portions of the belt members.

6. A microfilm shredding device as defined in claim 4 or claim 5, wherein the endless belt members are timing belts, so supported on the guide rolls that the teeth of each timing belt face towards the strip feed gap, on the one side, and towards the drive member of the conveyor drive, on the opposite side of the belt circumference.

7. A microfilm shredding device as defined in claim 4 or claim 5, wherein the endless belt members are O-rings of round cross section, the O-rings being guided by annular grooves in the guide rolls.

8. A microfilm shredding device as defined in claim 7, wherein the endless belt members include return portions extending between the first and third guide rolls; and the strip feeding conveyor further includes a stationary wiper brush engaging the return portions of the endless belt members near the point where they leave the first guide roll.

9. A microfilm shredding device as defined in claim 1, or claim 2, or claim 4, wherein the strip advancing means further includes a plurality of elongated stationary guide members which are arranged between the transversely spaced strip advancing members so as to alternate therewith; and the guide members have one extremity located in the vicinity of the first cutting position and at least an adjoining end portion extending substantially parallel to the guide surface of the stationary guide plate.

10. A microfilm shredding device as defined in claim 9, wherein the guide members are guide needles which are arranged laterally between the endless belt members;

the first and second guide rolls for the belt members include shallow annular grooves positioning the guide needles in the lateral sense; and each guide needle engages an annular groove of the second guide roller with an end loop in the shape of an eye, so as to be pivotable towards the stationary guide plate, around the center of the second guide roll.

11. A microfilm shredding device as defined in claim 1, or claim 2, or claim 4, wherein the feeding unit frame, the strip advancing means, and the associated drive form a displaceable feeding unit subassembly which includes, as part of said retracting means, means for guiding the feeding unit subassembly between a first, operative position of the strip advancing means and a second, retracted position of the strip advancing means.

12. A microfilm shredding device as defined in claim 11, wherein the operative position of the strip advancing means is determined by feeding unit abutment means arranged between the feeding unit frame and the main frame.

13. A microfilm shredding device as defined in claim 12, wherein the width of the strip feed gaps is adjustable through adjustment of the feeding unit abutment means.

14. A microfilm shredding device as defined in claim 12, further comprising means biasing the feeding unit subassembly towards the operative position of the strip advancing means.

15. A microfilm shredding device as defined in claim 14, wherein said biasing means includes at least one spring.

16. A microfilm shredding device as defined in claim 14, wherein the drive for the strip advancing means operates independently of the power drive of the shredding cutter; and the strip feeding unit further includes a safety switch which is arranged between the feeding unit frame and the main frame, the safety switch being adjusted to shut down the conveyor drive, when the feeding unit subassembly is displaced away from the operative position of the strip advancing means by an excess of information carrier material entering the strip feed gaps.

17. A microfilm shredding device as defined in claim 14, wherein the drive for the strip advancing means operates independently of the power drive of the shredding cutter and has at least one slow-operating speed, in addition to a normal operating speed; and the strip feeding unit further includes a control switch having at least three switching positions which, respectively, control the normal operating speed, at least one slow-operating speed, and the shutdown of the advancing means drive, the control switch being arranged between the feeding unit frame and the main frame and adjusted to respond to displacements of the feeding unit frame in such a way that, when the feeding unit subassembly is in its normal abutted position, the advancing means drive operates at normal speed, and when the feeding unit subassembly is displaced a small distance away from its abutted position, due to a small excess of information carrier material entering the strip feed gaps, the advancing means drive operates at a slow-operating speed, and when the feeding unit subassembly is displaced a greater distance away from its abutted position, due to a large excess of information carrier material entering the strip feed gaps, the advancing means drive is shut down.

18. A microfilm shredding device as defined in claim 11, wherein the displaceability of the feeding unit subassembly is obtained by means of a pivot connection between the feeding unit frame and the main frame, on an axis which is parallel to the axis of the shredding cutter, the pivot connection being located in relation to the shredding cutter axis in such a way that, in a pivoting displacement, that part of the strip advancing means which is located closest to the first cutting position moves away from the cutter and away from the guide plate, in an approximately diagonal direction.

19. A microfilm shredding device as defined in claim 11, wherein the displaceability of the feeding unit subassembly is obtained by means of a straight-line guide between the feeding unit frame and the main frame, the straight-line guide including guide pins in one frame and cooperating guide bushings in the other frame, the direction of displaceability being substantially perpendicular to the guide surface of the guide plate.

20. A microfilm shredding device as defined in claim 11, wherein the displaceability of the feeding unit subassembly is obtained by means of a parallel-linkage-type pivot connection between the feeding unit frame and the main frame, the pivot connection including a plurality of two-point links of identical length connecting the two frames in such a way that the feeding unit subassembly, in a pivoting displacement, moves away from the shredding cutter and away from the guide plate, in an approximately diagonal direction.

21. A microfilm shredding device as defined in claim 11, wherein the drive for the strip feed conveyor includes a speed-adjustable electric motor supported by the feeding unit frame in a coaxial arrangement with the third guide roll of the strip feed conveyor, and elastic coupling means arranged between the motor and said guide roll.

* * * * *